US005819719A

United States Patent [19]

Vidal

[11] Patent Number: 5,819,719

[45] Date of Patent: Oct. 13, 1998

[54] OUTDOOR STOVE AND STAND

[76] Inventor: Arturo S. Vidal, 3825 Brentwood Crescent, Virginia Beach, Va. 23452

[21] Appl. No.: 517,729

[22] Filed: Aug. 21, 1995

[51] Int. Cl.[6] ..... F24C 3/00

[52] U.S. Cl. ..... 126/41 R; 126/220; 126/304 A

[58] Field of Search ..... 126/41 R, 41 A, 126/42, 304 R, 304 A, 25 R, 25 A, 38, 39 B, 276, 220; 431/344, 343

[56] References Cited

U.S. PATENT DOCUMENTS

| | | | |
|---|---|---|---|
| 2,390,234 | 12/1945 | Applebaum | 126/42 |
| 5,140,973 | 8/1992 | Home | 126/41 R |
| 5,241,948 | 9/1993 | Thibodeau | 126/304 A |
| 5,408,985 | 4/1995 | Giebel et al. | 126/41 R |

*Primary Examiner*—James C. Yeung

*Attorney, Agent, or Firm*—Michael J. Colitz, Jr.

[57] ABSTRACT

A portable outdoor stove and stand is disclosed. A support table has four vertically extending legs parallel with respect to each other in a rectangular configuration. The support table has a horizontal surface and a horizontal lower surface secured to the upper ends of the legs through pivot pins. Two of the legs adjacent to one edge of the table are provided with wheels. The support surface has downwardly extending side walls including a front side wall, a rear side wall and parallel end walls. A pair of laterally disposed apertures are formed in the upper surface with a recessed burner within each aperture. Each aperture has beneath the burner a drip pan and a burner support thereover for maintaining cookware thereon. The front wall has a pair of small apertures with recessed switches therein for controlling the flame in each burner. A lower shelf is secured between the legs adjacent the lower extents thereof. A propane tank is positioned on the lower shelf with lines extending upwardly to the burners and the associated switches.

2 Claims, 3 Drawing Sheets

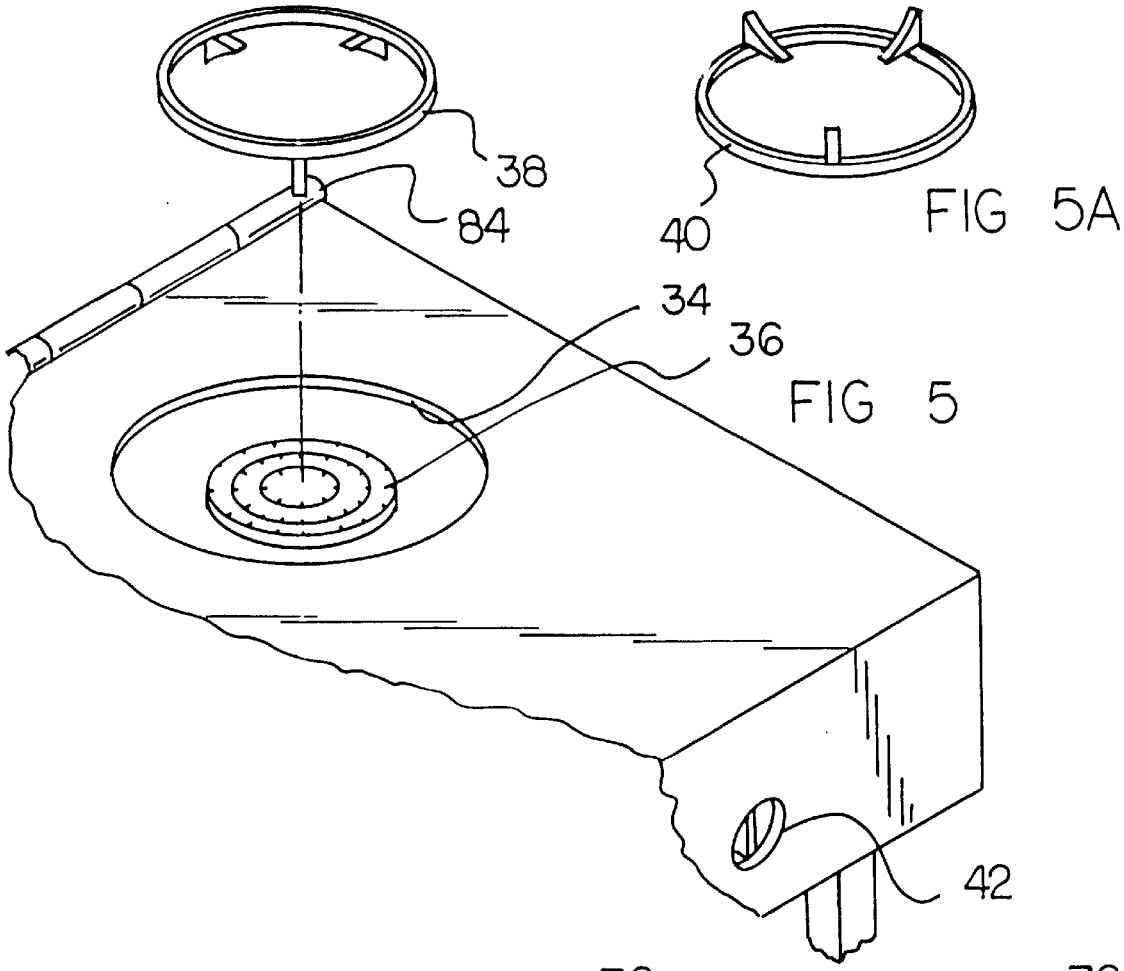
FIG 5A
FIG 5
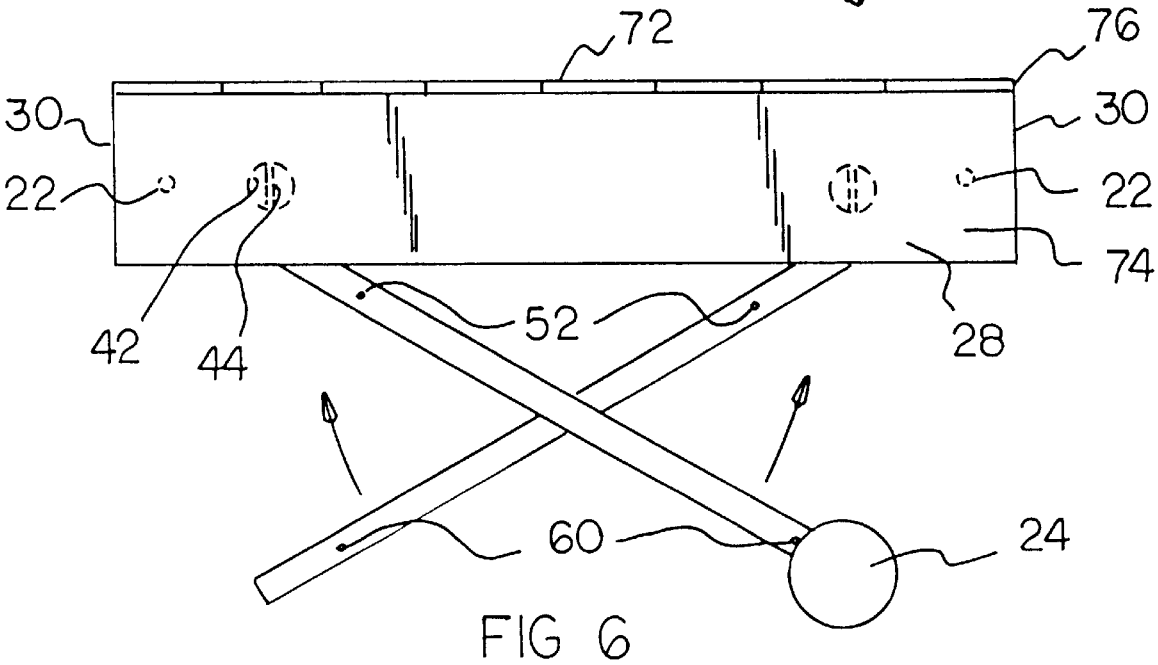
FIG 6

OUTDOOR STOVE AND STAND

BACKGROUND OF THE INVENTION

1. Field of the Invention

The present invention relates to an outdoor stove and stand and, more particularly, pertains to permitting cooking at locations remote from the kitchen.

2. Description of the Prior Art

The use of stoves, cooktops and other cooking devices of various designs and configurations is known in the prior art. More specifically, stoves, cooktops and other cooking devices of various designs and configurations heretofore devised and utilized for the purpose of configuring stoves for portability through various methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,385,619 to Casinelli, deceased, a portable stove.

U.S. Pat. No. 4,905,659 to Armistead discloses a portable camp stove and fuel container.

U.S. Pat. No. Des. 249,448 to Vache discloses a portable cartridge gas cooking stove.

U.S. Pat. No. Des. 252,971 to Ito discloses a portable gas stove.

Lastly, U.S. Pat. No. Des. 336,008 to Kamata discloses a portable gas cooking stove.

In this respect, the outdoor stove and stand according to the present invention substantially departs from the conventional concepts and designs of the prior art, and in so doing provides an apparatus primarily developed for the purpose of permitting cooking at locations remote from the kitchen.

Therefore, it can be appreciated that there exists a continuing need for a new and improved outdoor stove and stand which can be used for permitting cooking at locations remote from the kitchen. In this regard, the present invention substantially fulfills this need.

SUMMARY OF THE INVENTION

In view of the foregoing disadvantages inherent in the known types of stoves, cooktops and other cooking devices of various designs and configurations now present in the prior art, the present invention provides an improved outdoor stove and stand. As such, the general purpose of the present invention, which will be described subsequently in greater detail, is to provide a new and improved outdoor stove and stand and method which has all the advantages of the prior art and none of the disadvantages.

To attain this, the present invention essentially comprises a new and improved outdoor stove and stand comprising, in combination, a support table having four vertically extending legs parallel with respect to each other in a rectangular configuration, the support table having a horizontal surface and a horizontal lower surface secured to the upper ends of the legs through pivot pins, two of the legs adjacent to one edge of the table being provided with wheels, the support surface having downwardly extending side walls including a front side wall, a rear side wall and parallel end walls; a pair of laterally disposed apertures formed in the upper surface with a recessed burner within each aperture, each aperture having beneath the burner a drip pan and a burner support thereover for maintaining cookware thereon, the front wall having a pair of small apertures with recessed switches therein for controlling the flame in each burner; an upper shelf secured between the four legs adjacent the upper extents thereof and beneath the lower edge of the side panels and a lower shelf secured between the legs adjacent the lower extents thereof; a propane tank positioned on the lower shelf with lines extending upwardly to the burners and the associated switches; a cover having a large central plate positionable over the upper surface of the table and having a downwardly extending front plate secured to the front edge of the central plate through a front hinge to shield the switches and a rear hinge, the rear hinge permanently secured to the rear edge of the central panel and the table; and hinges coupling the upper ends of the legs to the front and rear walls of the table for allowing the collapsing of the legs for storage and transportation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved outdoor stove and stand which has all the advantages of the prior art stoves, cooktops and other cooking devices of various designs and configurations and none of the disadvantages.

It is another object of the present invention to provide a new and improved outdoor stove and stand which may be easily and efficiently manufactured and marketed.

It is a further object of the present invention to provide a new and improved outdoor stove and stand which is of a durable and reliable construction.

An even further object of the present invention is to provide a new and improved outdoor stove and stand which is susceptible of a low cost of manufacture with regard to both materials and labor, and which accordingly is then susceptible of low prices of sale to the consuming public, thereby making such stoves, cooktops and other cooking devices of various designs and configurations economically available to the buying public.

Still yet another object of the present invention is to provide a new and improved outdoor stove and stand which provides in the apparatuses and methods of the prior art some of the advantages thereof, while simultaneously overcoming some of the disadvantages normally associated therewith.

Even still another object of the present invention is to permit cooking at locations remote from the kitchen.

Lastly, it is an object of the present invention to provide a portable outdoor stove and stand. A support table has four vertically extending legs parallel with respect to each other in a rectangular configuration. The support table has a horizontal surface and a horizontal lower surface secured to the upper ends of the legs through pivot pins. Two of the legs adjacent to one edge of the table are provided with wheels. The support surface has downwardly extending side walls including a front side wall, a rear side wall and parallel end walls. A pair of laterally disposed apertures are formed in the upper surface with a recessed burner within each aperture. Each aperture has beneath the burner a drip pan and a burner support thereover for maintaining cookware thereon. The front wall has a pair of small apertures with recessed switches therein for controlling the flame in each burner. A lower shelf is secured between the legs adjacent the lower extents thereof. A propane tank is positioned on the lower shelf with lines extending upwardly to the burners and the associated switches.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an exploded perspective view of a portion of the upper surface of the apparatus shown in FIG. 2.

FIG. 5A is an enlarged bottom perspective view of one of the burner supports of the apparatus shown in FIG. 2.

FIG. 6 is a side elevational view of the apparatus shown in FIGS. 1, 2 and 3 in a partially collapsed orientation.

The same reference numerals refer to the same parts throughout the various Figures.

DESCRIPTION OF THE PREFERRED EMBODIMENT

Figure 1:
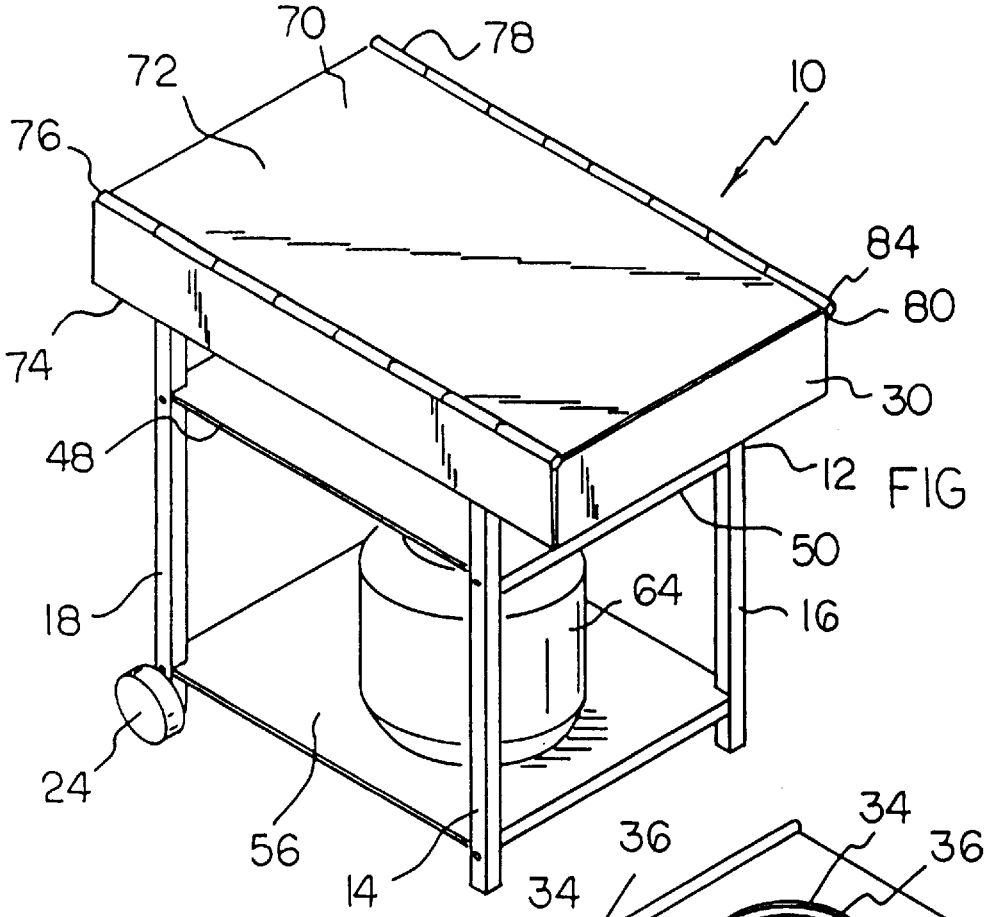
FIG. 1 is a perspective illustration of the preferred embodiment of the new and improved outdoor stove and stand constructed in accordance with the principles of the present invention.
Figure 2:
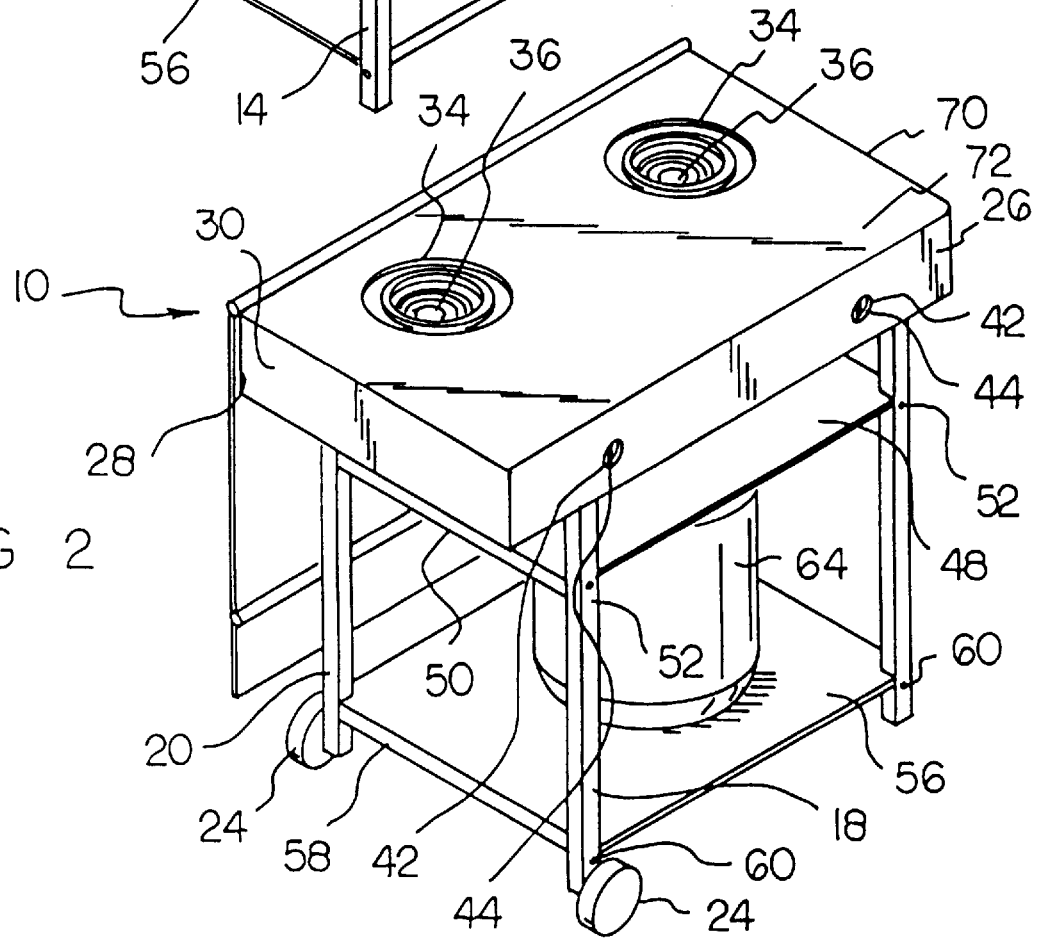
FIG. 2 is a perspective illustration of the apparatus shown in FIG. 1 but illustrated from an opposite side and with the cover removed.
Figure 3:
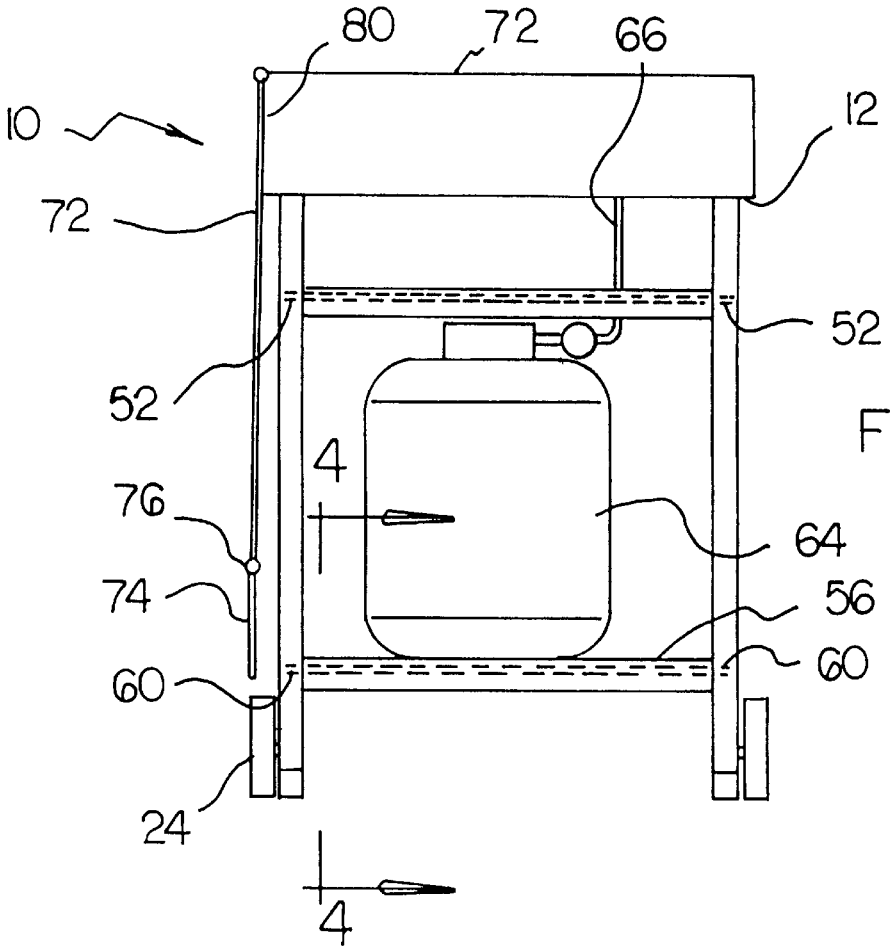
FIG. 3 is a front elevational view of the apparatus shown in FIGS. 1 and 2.
Figure 4:
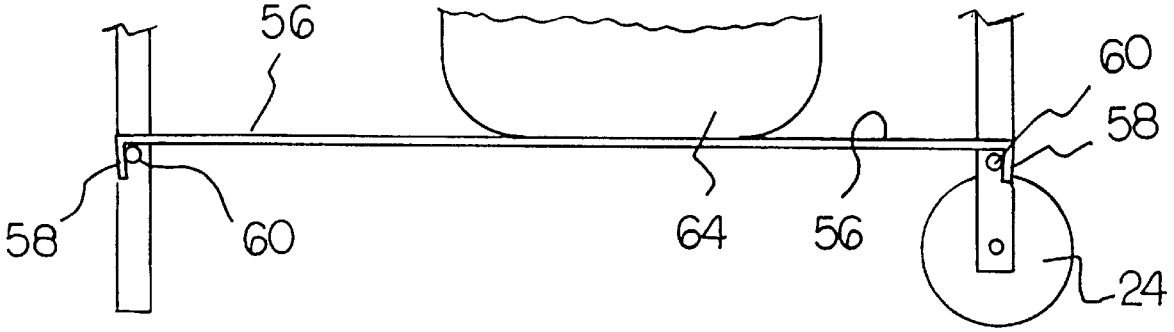
FIG. 4 is an enlarged side elevational view of the lower region of the apparatus shown in the prior Figure.

With reference now to the drawings, and in particular to FIG. 1 thereof, the preferred embodiment of the new and improved outdoor stove and stand embodying the principles and concepts of the present invention and generally designated by the reference numeral 10 will be described.

The present invention, the new and improved outdoor stove and stand, is a system 10 comprised of a plurality of components. In their broadest context, the components include a support table, a pair of apertures, an upper shelf, a lower shelf, a propane tank, a cover and hinges. Each of the individual components is specifically configured and correlated one with respect to the other so as to attain the desired objectives.

More specifically, the invention is a system 10 which has as its central component a table 12. Such table has four vertically extending legs 14,16,18,20 positionable parallel with respect to each other during operation and use. During operation and use such legs are in a rectangular configuration. The table has a horizontal upper surface and a horizontal lower surface which is secured to the upper ends of the legs. Such coupling is through pivot pins 22. Two of the legs, those adjacent to one edge of the table, are provided with wheels 24. The support surface also has downwardly extending side walls including a front side wall 26, a rear side wall 28 and parallel end walls 30.

Also in association with the support table are a pair of laterally disposed apertures 34. Such apertures are formed in the upper surface. A recessed burner 36 is located within each aperture. Each aperture also has in a lower extent thereof beneath the burner, a drip pan 38. In addition, a burner support 40 is located over the drip pan and burner for maintaining cookware thereon during operation and use. In addition, the front wall has a pair of small apertures 42. Recessed switches 44 are located therein for controlling a valve for varying the flame in each burner during operation and use.

To provide additional convenience to the user and stability to the legs, an upper shelf 48 is provided with a horizontal central extent and downturned legs 50. Such shelf is adapted to be removably secured between the four legs adjacent to upper extents thereof. Such location is beneath the lower edge of the side panels. The upper shelf is supported on pins 52 extending toward each other spanning the front legs and the back legs.

In addition to the upper shelf, there is also provided a lower shelf 56. Such lower shelf is secured between the legs adjacent to the lower extents thereof. Again, such shelf has an enlarged central extent with two downwardly extending legs 58 adapted to rest on pins 60 facing toward each other from the other adjacent legs of the support table.

In the preferred embodiment, a propane tank 64 is provided for supporting a fire during operation and use. Such tank is positioned on the lower shelf. It includes lines 66 which extend upwardly to the burners with control being effected with the switches as described hereinabove.

There is also provided is a cover 70. Such cover has a large central plate 72. The central plate is positionable over the upper surface of the table. The central plate has a downwardly extending front plate 74. Such is secured to the front edge of the central plate through a pivot hinge 76. When in a downward position, the front plate shields the switches. In addition, there is provided a rear hinge 78 and a rear plate 80 permanently secured to the rear edge of the central panel and the table. The hinge effects the coupling therebetween.

Lastly provided are the hinges 84 coupling the upper ends of the legs to the front and rear walls of the table. Such hinges allow for the collapsing of the legs of the table when the shelves are removed to facilitate storage and transportation.

The present invention allows a wide variety of foods to be cooked outdoors any time of year on a one-or two-burner model L.P. gas stove and stand. This invention provides the same utility and options as an indoor gas stove and provides many advantages as well. It is ideal for cooking greasy and aromatic foods so the house does not fill up with too many smells and too much grease. Like an indoor stove, it can hold pots and pans and be used for deep frying, wok frying, soups and the like. It can also be used on special events and for large meals when the four indoor burners are filled. In cold weather, for holiday meals, the present invention can be used in the garage. In addition, it could be employed if the electricity or gas were shut off in emergencies.

The present invention features two models. The single-burner model comes with one 20-pound L.P. gas tank underneath; the double-burner model has two 20-pound tanks. Both models include foldable, detachable side flaps used to protect the stove when not in use which double as counter space for cooking implements or spices when in use. The stove is collapsible to fit into small storage spaces and car trunks. It is also rollable, with fold-out legs with wheel. It holds up to 150 pounds on its surface. Its electronic ignition means quick and easy lighting. A damper provides perfect gas combustion for a perfect flame. The burners are set into the surface to provide protection from high winds. The trivets are reversible so they can be used for pots and pans or woks.

The present invention can be put into action when camping or on the beach to allow a wide variety of foods to be cooked. It does not require a table to be set upon, and is easier to use than many camping stoves now on the market.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

It is claimed:

1. A new and improved outdoor stove and stand comprising, in combination:

a support table having four vertically extending legs parallel with respect to each other in a rectangular configuration, the support table having a horizontal upper surface and a horizontal lower surface secured to the upper ends of the legs through pivot pins, two of the legs adjacent to one edge of the table being provided with wheels, the support table having downwardly extending side walls including a front side wall, a rear side wall and parallel end walls;

a pair of laterally disposed apertures formed in the upper surface with a recessed burner within each aperture, each aperture having beneath the burner a drip pan and a burner support thereover for maintaining cookware thereon, the front wall having a pair of small apertures with recessed switches therein for controlling the flame in each burner;

an upper shelf secured between the four legs adjacent the upper extents thereof and beneath the lower edge of the side panels and a lower shelf secured between the legs adjacent the lower extents thereof;

a propane tank positioned on the lower shelf with lines extending upwardly to the burners and the associated switches;

a cover having a large central plate positionable over the upper surface of the table and having a downwardly extending front plate secured to a front edge of the central plate through a front hinge to shield the switches and a rear hinge, the rear hinge permanently secured to the rear edge of a central panel and the table; and hinges coupling the upper ends of the legs to the front and rear walls of the table for allowing the collapsing of the legs for storage and transportation.

2. An outdoor stove and stand comprising:

a support table having four vertically extending legs parallel with respect to each other in a rectangular configuration, the support table having a horizontal upper surface and a horizontal lower surface secured to the upper ends of the legs through pivot pins, two of the legs adjacent to one edge of the table being provided with wheels, the support table having downwardly extending side walls including a front side wall, a rear side wall and parallel end walls;

a pair of laterally disposed apertures formed in the upper surface with a recessed burner within each aperture, each aperture having beneath the burner a drip pan and a burner support thereover for maintaining cookware thereon, the front wall having a pair of small apertures with recessed switches therein for controlling the flame in each burner;

a lower shelf secured between the legs adjacent the lower extents thereof;

a propane tank positioned on the lower shelf with lines extending upwardly to the burners and the associated switches;

a cover having a large central plate positionable over the upper surface of the table and having a downwardly extending front plate secured to a front edge of the central plate through a front hinge to shield the switches and a rear hinge, the rear hinge permanently secured to a rear edge of the central panel and the table; and hinges coupling the upper ends of the leas to the front and rear walls of the table for allowing the collapsing of the legs for storage and transportation.

* * * * *